US006453503B1

(12) United States Patent
Chen

(10) Patent No.: US 6,453,503 B1
(45) Date of Patent: Sep. 24, 2002

(54) CLEANING BRUSH

(76) Inventor: Ching-Chen Chen, No. 552, Kuang Fu Rd., Pei Tou, Chang Hua Hsien (TW)

( * ) Notice: Subject to any disclaimer, the term of this patent is extended or adjusted under 35 U.S.C. 154(b) by 23 days.

(21) Appl. No.: 09/799,678

(22) Filed: Mar. 7, 2001

(51) Int. Cl.[7] ..... A47K 7/02
(52) U.S. Cl. ..... 15/209.1; 15/229.13
(58) Field of Search ..... 15/209.1, 229.11, 15/229.12, 229.13

(56) References Cited

U.S. PATENT DOCUMENTS 1,928,111 A * 9/1933 Mednick
3,761,993 A * 10/1973 Kim
5,687,447 A * 11/1997 Bynum et al.
5,944,032 A 8/1999 Masterson ..... 132/290
6,041,466 A * 3/2000 Payton
6,092,258 A 7/2000 Chen ..... 15/209.1
6,276,022 B1 * 8/2001 Gallacher
6,370,723 B1 * 4/2002 Chang

FOREIGN PATENT DOCUMENTS

JP 11-18977 * 1/1999

* cited by examiner

*Primary Examiner*—Terrence R. Till
(74) *Attorney, Agent, or Firm*—Troxell Law Office PLLC

(57) ABSTRACT

Cleaning brush including an elastic mesh tube having a predetermined length and diameter, a grip and a string-like fastening member. The elastic mesh tube is axially squeezed to form continuous crimps on the periphery of the mesh tube. The grip is disposed on outer side of the elastic mesh tube and formed with a recessed receptacle and several fixing sections radially passing through the wall of receptacle. The fastening member is wound between the fixing sections and one side of the mesh tube opposite to the grip to fix the mesh tube to form at least two linear pressing sections for pressing and fixing the expanded mass-like spongy mesh tube on the grip and avoiding swinging of the mesh tube during use.

8 Claims, 6 Drawing Sheets

CLEANING BRUSH

BACKGROUND OF THE INVENTION

The present invention is related to a personally used cleaning implement, and more particularly to a cleaning brush having a mass of spongy cleaning section which is subject to swinging during use.

A conventional cleaning brush has a grip on which an elastic mesh tube is fixed. The mesh tube is expanded to form a spongy cleaning section. U.S. Pat. Nos. 5,944,032 and 6,092,258 disclose such cleaning brushes. However, such cleaning brushes can be hardly used for cleaning a user's face. With respect to the former, this is because that a fastened section is formed at the center of the cleaning brush, which is considerably hard. When moving on the user's face, the user will feel uncomfortable. In the case that smaller elastic mesh tube is fixed on the grip for reducing the size of the hard section, the expanded spongy section will be too small to fully clean the face. Moreover, the ball-like expanded mesh tube often revolves or swings about the grip. This leads to inconvenience in use. With respect to the latter, the cleaning section is elongated and can be hardly used for cleaning the user's face.

SUMMARY OF THE INVENTION

It is therefore a primary object of the present invention to provide a cleaning brush which can be comfortably used for cleaning a user's face.

It is a further object of the present invention to provide the above cleaning brush in which the elastic mesh tube fixed on the grip is prevented from swinging or detaching from the grip.

According to the above objects, the cleaning brush of the present invention includes an elastic mesh tube having a predetermined length and diameter, a grip and a string-like fastening member. The elastic mesh tube is axially squeezed to form continuous crimps on the periphery of the mesh tube. The grip is disposed on outer side of the elastic mesh tube and formed with a recessed receptacle and several fixing sections radially passing through the wall of receptacle. The fastening member is wound between the fixing sections and one side of the mesh tube opposite to the grip to fix the mesh tube to form at least two linear pressing sections for pressing and fixing the expanded mass-like spongy mesh tube on the grip.

The present invention can be best understood through the following description and accompanying drawings wherein:

DETAILED DESCRIPTION OF THE PREFERRED EMBODIMENTS

Figure 1:
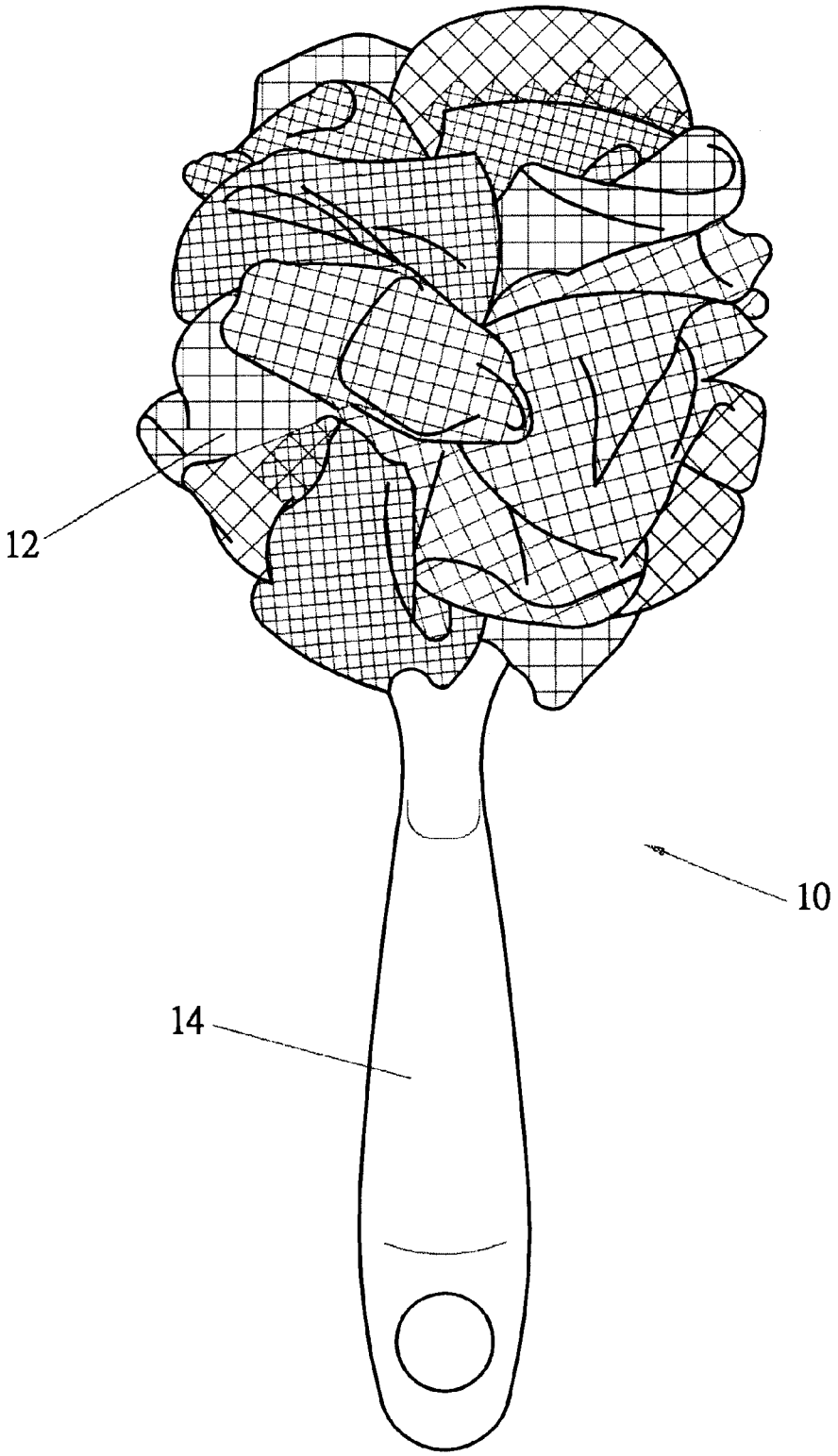
FIG. 1 is a front view of a first embodiment of the present invention.
Figure 2:
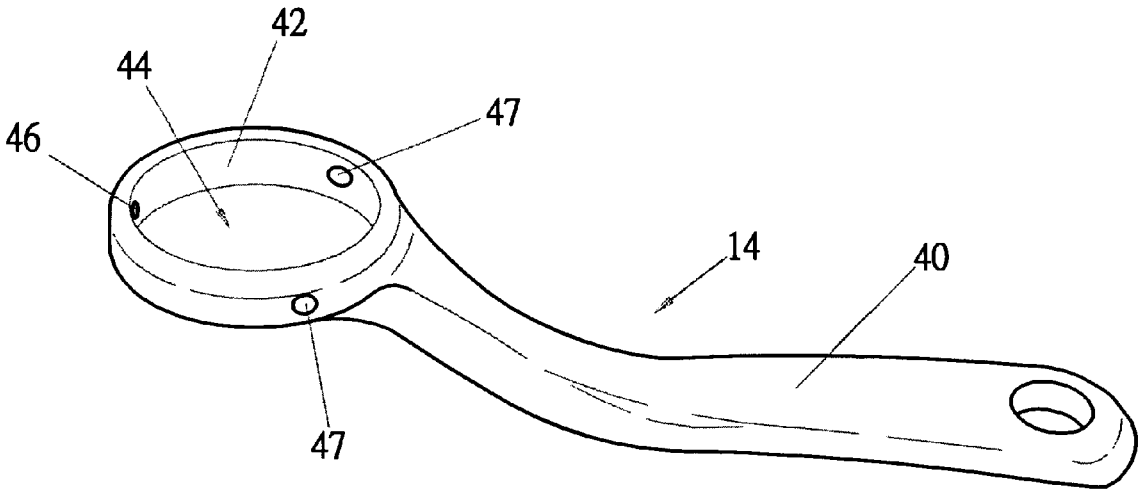
FIG. 2 is a perspective view of the grip of the first embodiment of the present invention.
Figure 3:
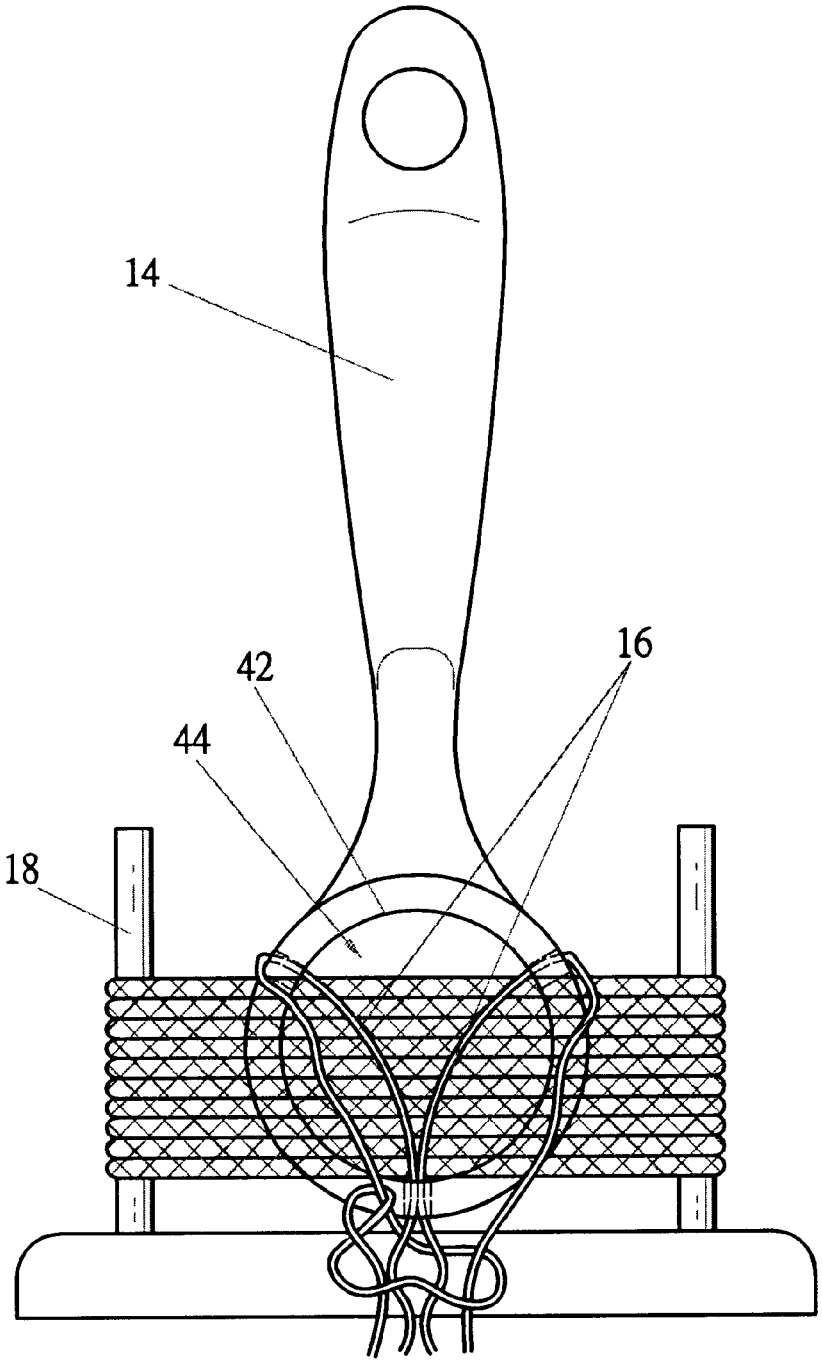
FIG. 3 is a front view of the first embodiment of the present invention when manufactured.

Please refer to FIGS. 1 to 3. The cleaning brush 10 of the present invention includes a tubular elastic mesh 12, a grip 14 having a certain length and a pair of fastening members 16 for fixing the elastic mesh tube 12 on the grip 14.

The elastic mesh tube 12 is made of plastic material by integral molding and has a certain length, dimension, elasticity and numerous meshes formed over the elastic mesh tube 12. In manufacturing, with the axial hole of the elastic mesh tube 12 slightly transversely extended, the elastic mesh tube 12 is downward fitted around two rod members 18 spaced from each other by a certain distance. The portion of the elastic mesh tube 12 protruding beyond the upper ends of the rod members 18 is continuously downward pushed. Accordingly, the periphery of the elastic mesh tube 12 is squeezed and crimped to form waved shape on the rod members 18. The profile of the elastic mesh tube 12 as a whole is such changed that the vertical length is shortened, while the transverse width is enlarged to have a form of short barrel.

The grip 14 has a handle section 40 at one end for a user to hold. The other end of the grip 14 is a flat section having an annular projecting wall 42 on the surface. The annular projecting wall 42 has a certain height and thickness. The inner circumference of the projecting wall 42 and the surface of the flat section define therebetween a receptacle 44 having an open end. The projecting wall 42 is formed with a first fixing section 46 and a pair of second fixing sections 47 spaced from each other by 120 degrees. In this embodiment, the fixing sections are through holes radially passing through the projecting wall 42.

When assembled, the grip 14 is positioned beside the mesh tube 12 with the lengthwise direction of the grip 14 parallel to the axis of the mesh tube 12. The receptacle 44 is attached to rear outer side of the mesh tube 12 still fitted around the rod members 18 (as shown in FIG. 3 ). Then, the two fastening members 16 are together inward conducted through the first fixing section 46 on the lower side. The tail ends of the fastening members 16 are extended to the front side of the mesh tube 12. Then, the tail ends of the fastening members 16 are respectively outward passed through the two second fixing sections 47 on upper side and then conducted downward to the rear side of the mesh tube 12. Then, the two fastening members 16 are pulled tightly to tie the head and tail ends thereof together. Accordingly, the mesh tube 12 is fixed on the grip 14. After a user takes off the mesh tube 12 from the rod members 18, due to the elasticity of the mesh tube 12 itself, the parts of the mesh tube 12, which are not compressed will expand toward the open end of the receptacle 44 to form a spongy expansion section for the user to clean his/her face.

By means of the receptacle 44 and the cooperative fixing sections 46, 47, the cleaning brush 10 of the present invention has the following advantages:

1. The fastening members 16 are tied between the spaced first and second fixing sections 46, 47 to form two independent linear pressing sections. By means of the linear pressing sections, in use of the cleaning brush, the expansion section is prevented from swinging left and right.
2. By means of the stopping effect of the projecting wall 42, the expanded mesh tube 12 can hardly separate from the receptacle 44. Therefore, the fixing effect is enhanced.
3. Most of the expanded parts of the mesh tube 12 are positioned at the open end of the receptacle 44 rather than divided into semispherical shapes positioned on front and rear sides of the grip 14. Therefore, the necessary material can be reduced.

Figure 4:
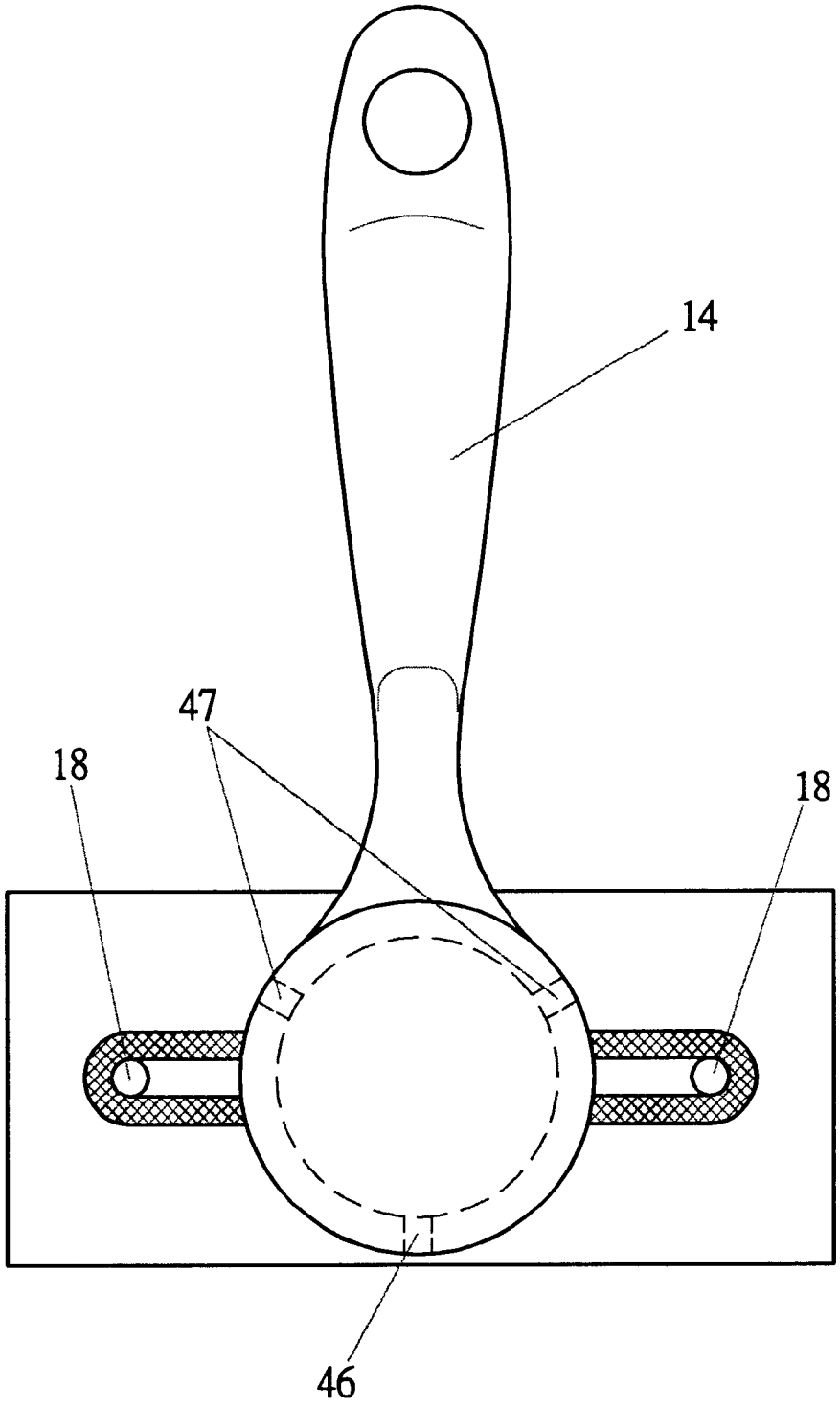
FIG. 4 is a top view of a second embodiment of the present invention when manufactured.

FIG. 4 shows another measure for connecting the elastic mesh tube 12 with the grip 14. Prior to assembly, the grip 14 is first placed onto the upper side of the mesh tube 12 with the open end of the receptacle 44 directed in a direction parallel to the axis of the mesh tube 12. The axis of the mesh tube could also be normal to the direction of the open end of the receptacle. Then, the fastening members 16 are used to press the mesh tube 12 against the receptacle 44. In this embodiment, the manner in which the mesh tube 12 is squeezed on the rod members 18 and the manner in which the fastening members 16 are conducted through the first and second fixing sections 46, 47 are both the same as the first embodiment.

Figure 6:
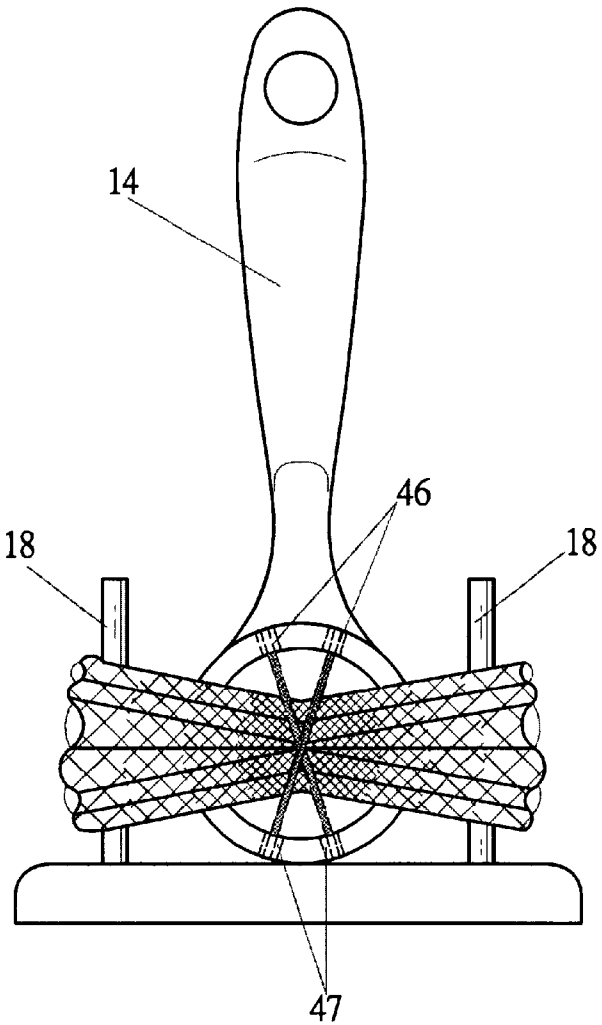
FIG. 6 is a front view of a fourth embodiment of the present invention when manufactured.
Figure 5:
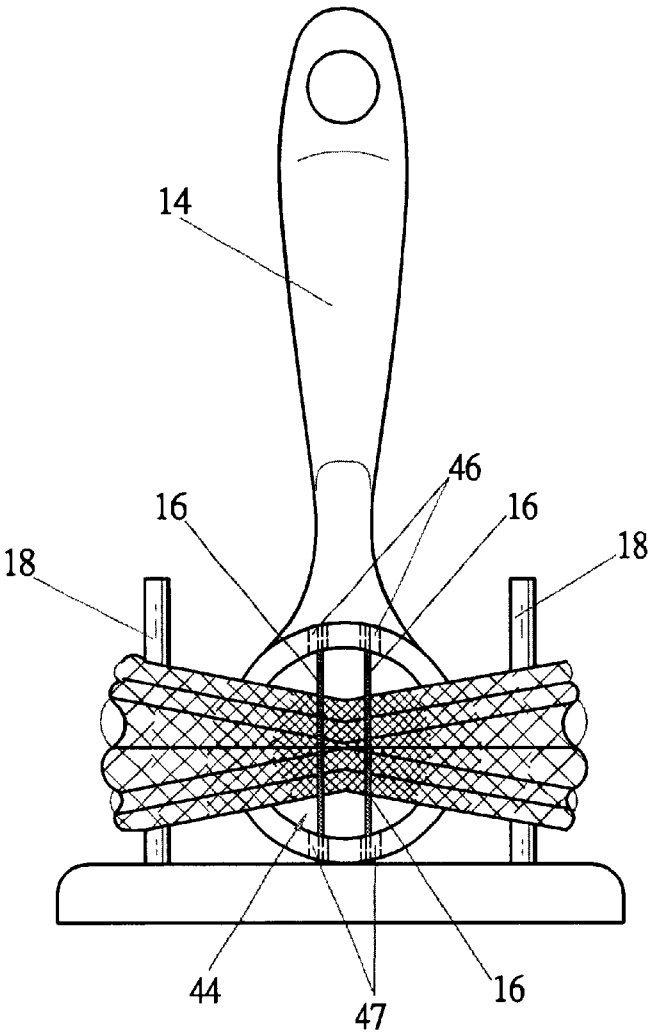
FIG. 5 is a front view of a third embodiment of the present invention when manufactured.

Please refer to FIGS. 5 and 6. A pair of first fixing sections 46 and a pair of second fixing sections 47 are disposed on the grip 14. The two fastening members 16 are respectively connected between two corresponding first and second fixing sections 46, 47 to form two linear pressing sections for pressing the mesh tube 12. The two linear pressing sections can be parallel to each other or intersect each other.

Alternatively, one single fastening member 16 can be continuously conducted through the first and second fixing sections 46, 47 to form at least two independent linear pressing sections so as to stably press the expanded elastic mesh tube 12 and prevent the same from swinging or separating. In addition, a certain number of mesh tubes 12 with different colors or different sizes of meshes can be assembled to form the elastic mesh tube 12.

Figure 7:
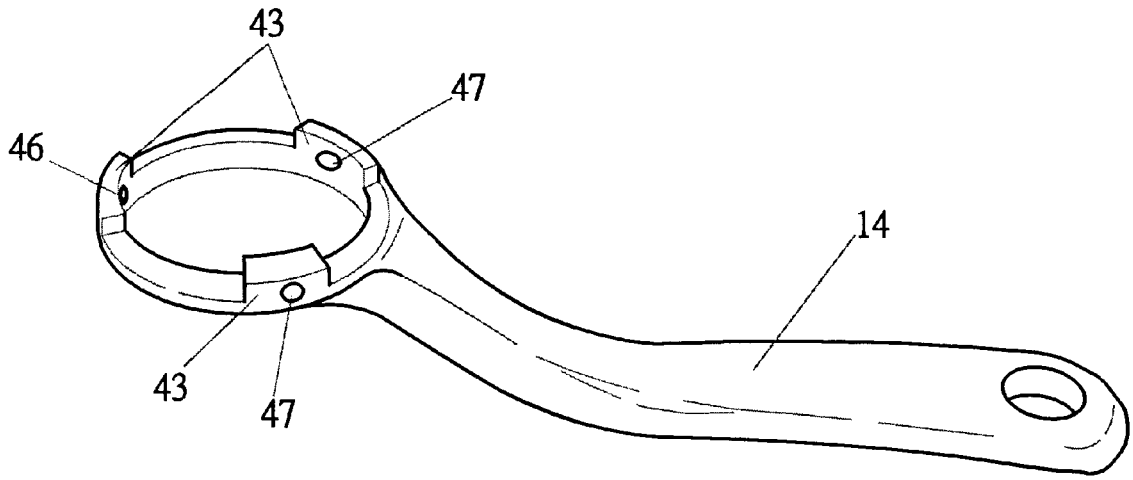
FIG. 7 is a perspective view of the grip of a fifth embodiment of the present invention.

FIG. 7 shows another configuration of the grip 14. Three arch projecting walls 43 with a certain height are disposed on the grip 14. The inner edges of the arch projecting walls 43 and the surface of the grip 14 define therebetween a receptacle 44. The through holes 46, 47 are respectively formed on the projecting walls 43. Accordingly, the fastening members 16 can be conducted through the through holes 46, 47 and connected with the projecting walls 43 to stop the elastic mesh tube 12 from detaching from the receptacle 44.

The above embodiments are only used to illustrate the present invention, not intended to limit the scope thereof. Many modifications of the above embodiments can be made without departing from the spirit of the present invention.

What is claimed is:

1. A cleaning brush comprising:

an elastic mesh tube having a predetermined length and diameter, a periphery of the elastic mesh tube being axially squeezed to form continuous crimps;

a grip disposed on outer side of the elastic mesh tube; and at least one fastening member having a predetermined length and flexibility, the fastening member being wound around a predetermined portion of the grip and one side of the mesh tube opposite to the grip to fix the mesh tube on the grip, said cleaning brush being characterized in that:

at least one projecting wall with a predetermined height is disposed on a surface of the grip, the projecting wall and the grip defining therebetween a receptacle having an open end, through the at least one open end of the receptacle, a part of the mesh tube being received in the receptacle;

at least one first fixing section and at least two second fixing sections are disposed on the projecting wall and spaced from each other by a predetermined distance; and predetermined portion of the fastening member is connected between the first and second fixing sections to form at least two pressing lines for pressing outer side of the mesh tube.

2. The cleaning brush as claimed in claim 1, wherein the first and second fixing sections are through holes radially passing through the at least one projecting wall.

3. The cleaning brush as claimed in claim 1, wherein the grip is formed with only one annular projecting wall and the first and second fixing sections are disposed on the annular projecting wall.

4. The cleaning brush as claimed in claim 1, wherein the grip is formed with several arch projecting walls and the first and second fixing sections are disposed on the arch projecting walls.

5. The cleaning brush as claimed in claim 1, wherein one end of the fastening member is connected to each second fixing section, while the other end of the fastening member is connected to the first fixing section.

6. The cleaning brush as claimed in claim 1, wherein the pressing lines of the fastening member for pressing the mesh tube are parallel to each other and spaced from each other by a predetermined distance.

7. The cleaning brush as claimed in claim 1, wherein the axis of the mesh tube is normal to the direction in which the open end of the receptacle is directed.

8. The cleaning brush as claimed in claim 1, wherein the axis of the mesh tube is parallel to the direction in which the open end of the receptacle is directed.

* * * * *